US005170972A

United States Patent [19]

Casals Guell

[11] Patent Number: 5,170,972

[45] Date of Patent: Dec. 15, 1992

[54] BASE FOR FURNITURE LEGS AND IMPROVEMENTS IN THE MANUFACTURE OF BASES

[76] Inventor: Pablo Casals Guell, C. Naria Cubi, 98, 08021 Barcelona, Spain

[21] Appl. No.: 716,947

[22] Filed: Jun. 18, 1991

[30] Foreign Application Priority Data

Jun. 20, 1990 [ES] Spain ..... 9001701
Jul. 25, 1990 [ES] Spain ..... 9002344
Nov. 19, 1990 [ES] Spain ..... 9002920

[51] Int. Cl.[5] ..... A47B 91/00

[52] U.S. Cl. ..... 248/188.9; 16/42 T; 411/41

[58] Field of Search ..... 248/188.8, 188.9, 188.91, 248/677; 16/42 T, 30, 32, 39; 411/41, 509; 24/453, 297

[56] References Cited

U.S. PATENT DOCUMENTS 1.757,962 5/1930 Herold ..... 248/188.9 X
2.860,368 11/1958 Thornbury ..... 16/42 T X
3,078,498 2/1963 Morgan ..... 16/42 T X
3,191,213 6/1965 Congdon ..... 16/42 T
4.741,548 5/1988 Schlanger ..... 411/41 X
5,010,621 4/1991 Bock ..... 16/42 T

FOREIGN PATENT DOCUMENTS 541293 5/1957 Canada ..... 248/188.8
3135296 3/1983 Fed. Rep. of Germany ..... 16/42 T
876471 9/1961 United Kingdom ..... 248/188.9

*Primary Examiner*—David L. Talbott
*Attorney, Agent, or Firm*—Steinberg & Raskin

[57] ABSTRACT

Improvements in the manufacture of a base for furniture legs comprising a tubular body and a rounded head closing one of its ends, characterized in that in the moulding stage of the base itself are formed a passage which traverses said head and a stem, extending inwards and outwards from said head, that tends externally in a disk or plate, for support over the floor surface, said stem being joined to the base by means of a thin wall that is easily broken to render the base operational.

Such a base offers a large contact surface with the floor, combining its support function with that of stabilization. The improvements in the manufacture allow to obtain in a single moulding operation the base body and its articulated support piece, in such a way that they stay united until they are installed on a furniture leg.

18 Claims, 3 Drawing Sheets

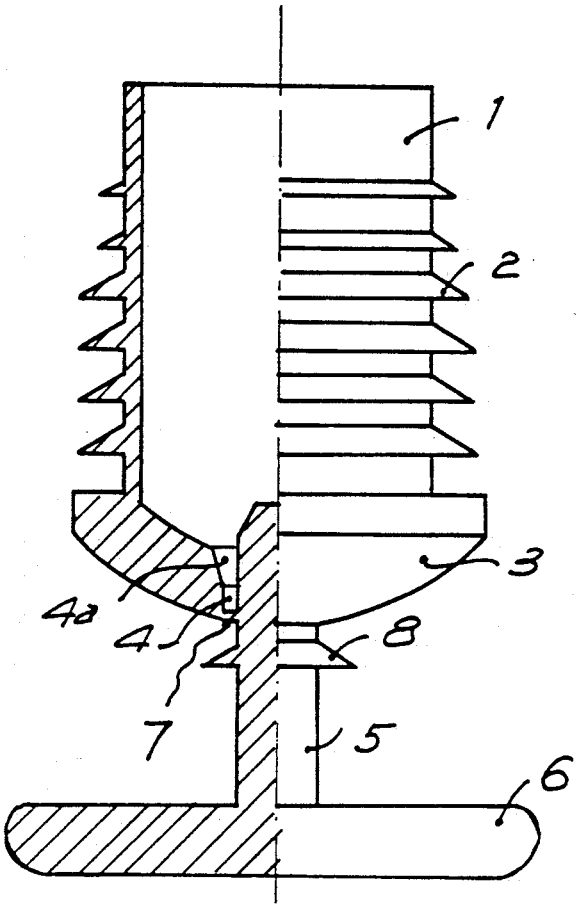
FIG. 1
FIG. 2
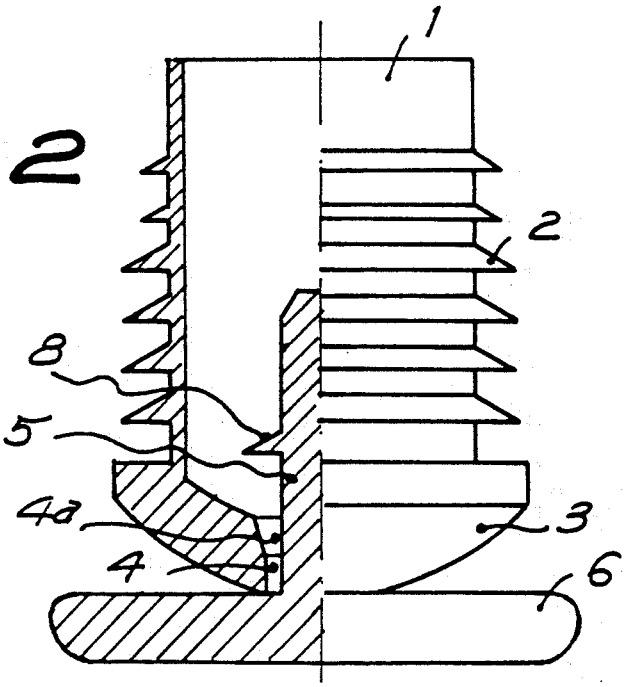

BASE FOR FURNITURE LEGS AND IMPROVEMENTS IN THE MANUFACTURE OF BASES

The present invention refers to bases for furniture legs, and in particular for the legs of tubular furniture, which combine with their support function that of stabilization, by presenting a larger contact surface with the floor, and it also refers to improvements introduced in the manufacture of such bases.

BACKGROUND OF THE INVENTION

Bases which have been known and utilized up to the present time are normally constituted by blind caps of an elastic or semi-elastic material, such as an appropriate plastic, whose blind end normally forms a rounded head. When the bases are intended for tubular furniture, the tubular body of the cap is in many cases provided with ribs which, due to their resilience are retained in the interior of the end of the corresponding furniture leg. The aforementioned head, in particular when the furniture legs are inclined, has a rounded external shape in order to provide tangency points with the floor to achieve stable support.

It is clear that the support offered by a structure of the kind indicated remains limited to said points of tangency with the floor, which means that the entire weight of the piece of furniture or similar object rests exclusively over these points with the resulting restricted stability, due to the small surface being covered.

When a greater level of stability is required, it is necessary to resort to the utilization of bases which incorporate a ball joint or similar component and which, due to its complicated manufacture and assembly, add significantly to the cost of the product.

BRIEF DESCRIPTION OF THE INVENTION

The improvements which are the object of this invention attempt to resolve the aforementioned problems by providing for a simplified base body, which incorporates an articulated support piece which increases the area of contact with the floor and, as a consequence, offers improved stability. Said base is preferably moulded in a single operation.

In accordance with the improvements indicated, at the same time as moulding the base, with its tubular body, externally rounded head and in some cases external ribs, there is also moulded a stem which protrudes internally and externally from the rounded base head via an orifice provided in the centre of the said head, and is joined to the head by a thin wall or portion which is easily breakable and forms part of the main base body. Said stem is provided at its external end with a flat head in the form of a disk or plate of any profile, appropriate to its function as a support for the base over the surface of the floor.

To render the base operational all that is required is to apply pressure over said flat head in order to rupture the thin inner wall which unites it with the main base body, with the result that the stem is fully introduced into said base body, the rounded head of which rests swingingly over said disk, allowing contact over an important surface with the floor, and furthermore enabling adaptation to any irregularities which the floor surface might present.

In order to avoid the escape of the stem and flat disk head assembly on raising the furniture piece from the floor, the external end of the stem is provided with an external protruding rib, adjacent to the area of union with the base body. This rib has a diameter slightly larger to that of the opening or passage through which the stem is introduced. In this way the stem, fully introduced in the base will enter under pressure within said base, and will remain located behind the shim of said head body without being able to escape but, equally, without impairing the swinging when the base has to perform its support function.

In the same way, in order to facilitate said swinging, the walls of the orifice or passage of the rounded base head are formed with their inner end enlarged inwards in order to allow the swinging of the inner end of the stem.

The invention equally refers to the base which results from the aforementioned improved manufacturing process, according to which said base, of the type constituted by a blind tubular cap with external protruding ribs and an externally rounded head is provided with a stem united to said base in the moulding process, which coaxially traverses said head via a passage formed in its centre, said stem being attached to a thin, easily breakable, wall which is united to the base body and seals said passage, the outer end of said stem being also provided with a flexible protruding rib whose diameter is slightly larger to that of the passage through which said stem is introduced.

The invention also refers to a similar base where the base body and the stem component, with its retention rib and support disk or plate, constitute two discrete components, moulded separately and subsequently assembled.

However experience has shown that both the moulding process, whether the components are moulded separately or together, and the subsequent introduction of the stem and the protruding rib of the support piece within the base, can prove to be excessively difficult. In addition, the fact that the rib is envisaged in the form of a collar around said stem also hinders the correct swinging movement of the stem, as a result of the excessive inner contact surface it offers.

In order to overcome these difficulties, according to another embodiment of the base, the stem with the attached disk or plate for supporting the base assembly over the surface of the floor is supplied with at least one pair of lugs obliquely protruding from said stem, which replace the rib or collar to which previous reference has been made.

Said stem may be advantageously moulded as a single unit with the base body, being attached to the mouth of the aforementioned passage solely by small weak radial points, easily broken under pressure, a feature which becomes possible thanks to the inner space allowed by the specified lugs. These radial points prove to the easier to break than the continuous wall envisaged in the previous embodiments.

However the invention also envisages that each of the component parts of the assembly (tubular base body and stem with support disk or plate) may be moulded separately and later assembled by introducing the latter into the former.

In either case, the stem will assume an essentially arrowhead shape, that can be introduced through said passage by compressing the oblique lugs, which open subsequently within the base interior and impede the escaped of this support piece. Furthermore said lugs only offer small internal points of contact and friction which do not hinder the swinging movement of the stem.

BRIEF DESCRIPTION OF THE DRAWINGS

To help provide a clearer understanding of the invention, the present description is accompanied by a number of drawings which schematically, and by way of example, with no limiting character whatsoever, represent a practical case of an embodiment of a base obtained following the manufacturing improvements which are the object of the invention.

In said drawings,

FIG. 1 is a side view, partially in axial cross section, of a base with the specified features, as is obtained after moulding the same using any conventional method;

FIG. 2 corresponds to a similar view of the same base, prepared and ready for attachment to the end of a furniture leg;

DESCRIPTION OF SOME PREFERRED EMBODIMENTS

Figure 3:
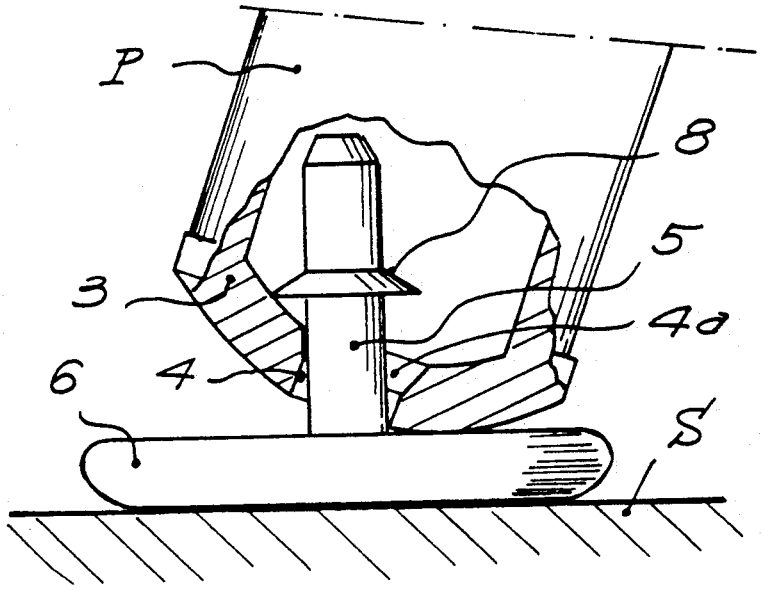
FIG. 3 is a partially sectioned view of a furniture leg showing one of the positions which could be adopted by the base during use.

With reference to FIGS. 1 to 3 and in accordance with the invention, during the moulding phase of the base, which is composed of the tubular body —1—, with ribs —2— to secure retention within the corresponding furniture leg, and with a rounded head —3— closing one of its ends, there is formed a passage —4— which traverses the head —3— and a stem —5—, which protrudes internally and externally from the portion of the head —3— and which terminates externally in a disk or plate —6— which provides support over the floor.

Said stem —5— is joined to the base by means of a thin wall or portion —7— which is easily broken.

In addition the external end of the stem if provided with a flexible rib —8— which can have a similar shape to those —2— of the tubular body —1— of the base and which has a slightly larger diameter to that of the passage —4—.

Finally the passage —4— has its inner end —4*a*— tapered in a frusto-conical shape in order to allow, as will be seen, the swinging movement of the tubular body 1 around the stem and the fully flat disposition of the disk or plate —6— over the floor.

Having been manufactured in this way, the base is rendered operational by braking the wall —7— and introducing the stem —5— fully within the body —1— up to the point where the disk or plate —6— is touching the rounded surface of the head —3—, introducing the rib —8— within the base, passing it under pressure through the passage —4— in such a way that it is unable to escape, while the stem —5— retains the freedom of allowing the tubular body 1 to swing or pivot around it by means of passage 4 (FIG. 3).

It should be noted that these operations of breaking the wall —7— and introducing the rib —8— through the passage —4— can be achieved in a single operation at the time of introducing the base into the furniture leg P or similar object by the application of a blow or by exerting the necessary pressure, in such a way that the wall —7— is ruptured and the rib —8— is compressed and forced through the passage —4—.

When the plate —6— is laid over a surface or floor S (FIG. 3) the stem —5— remains permanently vertical thanks to the swinging allowed by the passage —4— and its frusto-conical enlarged end —4*a*—, with the consequence that even when the furniture leg P is inclined, the base continues to rest on an ample and completely flat surface (corresponding to plate —6—), and as a result in optimum conditions of stability.

One of the novelties of the invention rests in the ability to obtain both the base unit and its support piece in a single moulding operation. The two component parts thus form a single body composed of the same material and therefore do not require other external elements to be assembled subsequently. This results in a product obtained at a significantly reduced cost and manufactured through an extremely efficient process.

In the same way the invention also refers to a similar base, in which the base body and the stem, with its retaining rib and its support disk or plate, consist of two independent parts, assembled after being moulded separately.

Figure 4:
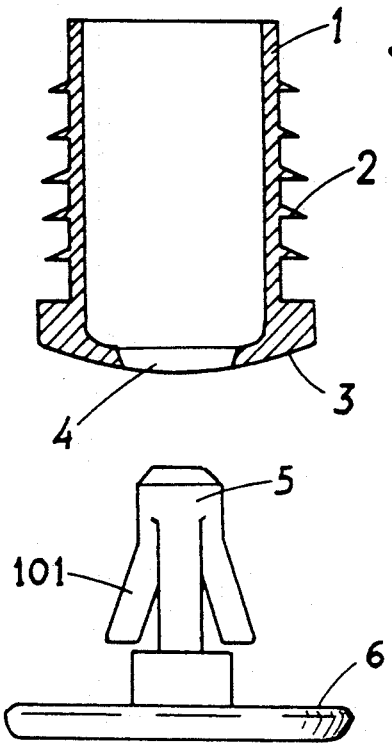
FIG. 4 is a side view, partially in axial cross section, of a base according to one of the specified embodiments distinguishing its discrete components.
Figure 5:
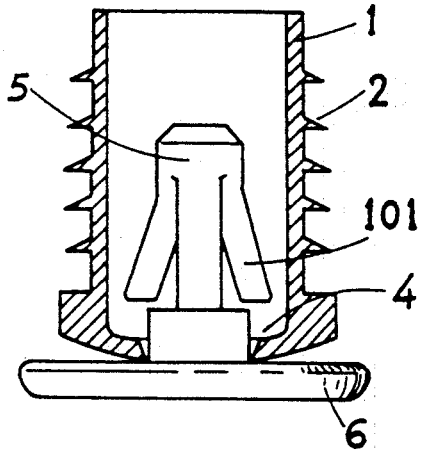
FIG. 5 shows a similar view, with the components assembled.

In FIGS. 4 to 7 a variant of this embodiment is represented, according to which, and as can be clearly seen in FIG. 4, the stem —5—, attached to the support disk or plate —6—, is supplied with a pair of lugs —101—, which replace the rib —8—, and protrude obliquely from the stem —5— in a direction opposite to that through which said stem is introduced into the body of the base itself through the passage —4— of the rounded head —3— of its tubular body —1—. These lugs —101— thus have an arrowhead shape and when compressed are easily introduced through passage —4—. In other respects the base performs the same function as in the previous embodiment, with the same objective, i.e. principally to protect the base from the wear entailed by direct contact with the floor as well as providing improved stability. The support piece, in cases of wear, can be easily replaced by cutting the stem —5—, and introducing a new independent support piece.

Figure 6:
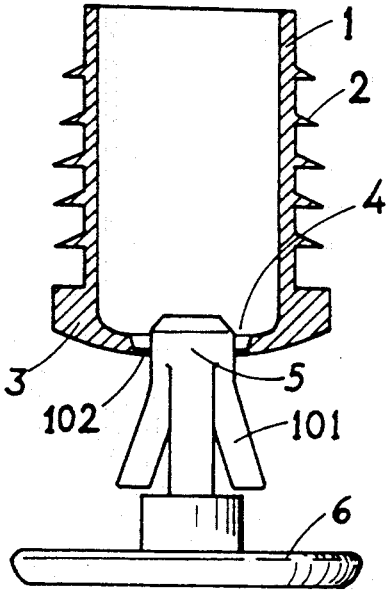
FIG. 6 represents a likewise side view of the preferred embodiment of the assembly.

The manufacture of both parts can be carried out independently, or, in the preferred embodiment as shown in FIG. 6, they can be moulded together in a single piece. In this latter case the stem —5— is joined to the main body by small, weak radial points —102— which are easily broken by the same pressure as is applied in introducing the stem through the passage —4—. This passage —4—, as can be seen in the figures, broadens from its outer mouth toward the inside, thus obviating the need for the truncated cone section envisaged in the previous embodiments.

Figure 7:
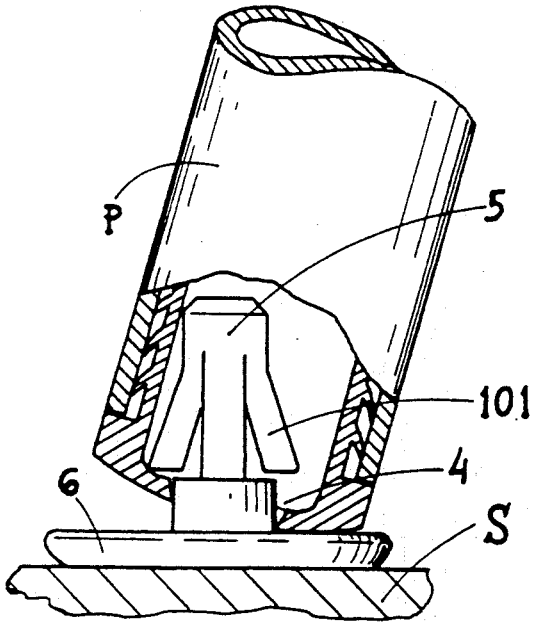
FIG. 7 is a view similar to that of FIG. 3, applied to this latter preferred embodiment.

In any event, as can be seen form FIG. 7, the operation of the base is the same as that envisaged in the previous embodiments, with the additional advantage that there is less internal friction. Above all there is a greater ease of manufacture and assembly of the component parts.

It should be noted that the union effected by the small weak radial points —102— can be achieved thanks to the possibility of moulding them due to the improved access allowed by the lugs —101—, whereas previously the presence of the rib —8— prevented the introduction of a punch to effect them.

Bases produced in this way will have the two components, be they moulded separately or together, ultimately held together by means of the oblique lugs —101— of the stem —5— and, in the case where they are moulded together as a single unit, will have said stem —5— attached to the body by small, weak radial points —102— which are easily broken. The lugs —101— allow a full swinging of the stem —5—, without friction liable to hinder its effective functioning in supporting the leg P of the furniture piece over the floor S.

It should be understood that when reference is made, in the embodiment shown in the drawings and the accompanying description, to the leg P of a piece of tubular furniture, to which the base is to be internally attached, an analogous embodiment could be produced with bases attached externally to the leg P in which case the ribs —2— would be unnecessary: i.e. the improvements which are the object of this invention can be applied equally to bases attached to the tubular leg P either externally or internally and can be provided, or not, with the ribs —2—, as required.

I claim:

1. Improvements in the manufacture of a base for furniture legs, said base comprising a tubular body, provided with means for securing said tubular body to a corresponding furniture leg and having a rounded support head at an end to be positioned nearest a floor, comprising molding first and second components of said base such that said first component comprises said head, said tubular body and a passage which traverses said head and said tubular body and such that said second component comprises a stem joined at one end to said tubular body by means of a thin-walled portion provided at said head which is easily broken upon insertion of said stem into said passage through said thin-walled portion, providing said stem with a disk-like plate at an opposite end thereof, and inserting said stem through said thin-walled portion and into said passage such that said stem extends inside said passage, and said disk-like plate extends externally for support over a floor surface.

2. Improvements in the manufacture of a base for the legs of tubular furniture, according to claim 1, further comprising providing an external wall of the stem for insertion into said passage with a protruding flexible rib whose diameter is slightly larger than that of an opening formed in said thin-walled portion leading to the passage.

3. Improvements in the manufacture of a base for the legs of tubular furniture, according to claim 2, further comprising providing the stem bearing the disk-like plate for supporting the base assembly over the floor surface, is provided with at least one pair of lugs protruding obliquely from said stem for insertion into said opening.

4. Improvements in the manufacture of a base for the legs of tubular furniture, according to claim 3, further comprising molding said second component having the stem with its lugs as a single unit with the body of the base, said lugs being joined to said thin-walled portion having small, weak radial points which are easily broken under pressure.

5. A base for furniture legs, obtained according to the improvements specified in claim 2, wherein said opening and said easily broken thin-walled portion are positioned at a center of said rounded support head, and said passage having an inner wall broadening inward and upward inside said tubular body traverses said rounded support head and said tubular body through a center thereof.

6. A base for furniture legs, according to claim 5, wherein said protruding flexible rib of said stem prevents disengagement of the stem from said tubular body when the furniture is raised from the floor, the diameter of said rib being slightly larger than that of the opening in said thin-walled portion through which it is introduced, said inner wall of said tubular body being defined by said passage and comprising a shim, said rib being thus located behind the shim of the tubular body of said base, after the introduction of the stem into the passage of the tubular body to form said base.

7. A base for furniture legs, according to claim 5, wherein said inner wall of said passage broadens inward and upward in said rounded head portion in order to facilitate relative pivotal movement between the stem and said first component of the base while the disk-like plate remains flat on the floor.

8. A base for furniture legs, according to claim 5, wherein the stem is provided with at least two lugs protruding obliquely from the stem at an end opposite said end having said disk-like plate.

9. A base for furniture legs according to claim 5, further comprising means for securing said tubular body to said corresponding furniture leg arranged on an exterior of said tubular body.

10. Improvements in the manufacture of a base for the legs of tubular furniture, according to claim 2, further comprising securing said tubular body to a corresponding furniture leg via a plurality of retention ribs arranged on an exterior of said tubular body.

11. Improvements in the manufacture of a base for the legs of tubular furniture, according to claim 10, further comprising breaking said thin-walled portion and compressing said rib of said stem through said thin-walled portion and into said passage as a single operation at the time of introducing the base into a furniture leg.

12. Improvements in the manufacture of a base for the legs of tubular furniture, according to claim 1, further comprising forming the passage with its inner wall broadening inwards and upwards inside said tubular body of said base.

13. A base for furniture legs, according to claim 1, wherein said disk-like end of said stem has a shape appropriate to its object of providing support for the base over the floor.

14. An improved base for a furniture legs, comprising a first component comprising a tubular body to be retained inside a tubular furniture leg and a rounded head portion arranged at a lower end thereof, said tubular body and said head including an interior passage which traverses said head and said tubular body, a second component comprising a stem joined at one end to said tubular body by means of a thin-walled portion provided on said head, said thin-walled portion of said head being easily broken upon insertion of said stem into said passage through said thin-walled portion, said stem further comprising a disk-like plate at an opposite end thereof for supporting a furniture leg on a floor surface;

a flexible protruding rib arranged at said end of said stem which is to be inserted into the passage, said flexible protuberance being larger than an opening of the passage formed when said thin-walled portion is broken, said head further comprising engagement means arranged in said passage in proximity to said thin-walled portion for preventing disengagement of said first and second components from one another, and allowing said first component to pivot around said second component such that the furniture leg may be inclined while said disk-like portion remains substantially flat on the floor.

15. The base for furniture legs according to claim 14, wherein said protruding flexible rib of said stem prevents disengagement of the stem from said tubular body when the furniture is raised from the floor, the diameter of said rib being slightly larger than that of the opening in said thin-walled portion through which it is introduced, said engagement means comprising a shim, said rib being thus located behind the shim of the tubular body of said base, after the introduction of the stem into the passage of the tubular body to form said base.

16. The base for furniture legs according to claim 15, further comprising means for securing said tubular body to said corresponding furniture leg arranged on an exterior of said tubular body.

17. The base for furniture legs according to claim 16, wherein said inner wall of said passage broadens inward and upward in said rounded head portion in order to facilitate relative pivotal movement between the stem and said first component of the base while the disk-like plate remains flat on the floor.

18. The base for furniture legs according to claim 14, wherein the stem is provided with at least two lugs protruding obliquely from the stem at an end opposite said end having said disk-like plate.

* * * * *